US010143343B1

(12) United States Patent
Miller, Sr.

(10) Patent No.: US 10,143,343 B1
(45) Date of Patent: Dec. 4, 2018

(54) STANDING ASSISTIVE DEVICE

(71) Applicant: Standing Improvements, LLC., South Bend, IN (US)

(72) Inventor: Robert L. Miller, Sr., South Bend, IN (US)

( * ) Notice: Subject to any disclaimer, the term of this patent is extended or adjusted under 35 U.S.C. 154(b) by 0 days.

(21) Appl. No.: 15/657,728

(22) Filed: Jul. 24, 2017

(51) Int. Cl.
*A47K 17/02* (2006.01)
*A61G 5/14* (2006.01)

(52) U.S. Cl.
CPC ..... *A47K 17/024* (2013.01); *A61G 5/14* (2013.01)

(58) Field of Classification Search
CPC .... A47K 17/024; A47K 17/022; A47K 3/125; A61G 5/14
USPC ..... 4/576.1
See application file for complete search history.

(56) References Cited

U.S. PATENT DOCUMENTS 2,059,171 A * 10/1936 Harris ..... A47K 3/003 4/576.1
3,228,038 A * 1/1966 Frank ..... A47K 3/001 4/576.1
3,286,283 A * 11/1966 Bertoldo ..... A47C 21/08 5/662
3,398,410 A * 8/1968 Sparling ..... A47K 17/022 4/254
3,474,471 A * 10/1969 Matibag ..... A47K 17/022 297/411.32
3,568,220 A * 3/1971 Dees ..... A47K 3/003 4/576.1
4,908,906 A * 3/1990 Hanna ..... A47K 17/024 16/445
4,976,455 A * 12/1990 Brammer, Sr. ..... B60P 3/36 16/319
5,306,217 A * 4/1994 Bracone ..... A63B 1/00 4/496
5,329,651 A * 7/1994 Mardero ..... A47K 3/003 4/561.1
5,590,440 A * 1/1997 Pelt ..... A47K 17/024 16/342
5,711,555 A * 1/1998 Leedy ..... E05C 19/184 292/202
5,832,542 A * 11/1998 Dominguez ..... A47K 17/026 4/254
5,970,535 A * 10/1999 Wayne ..... A47K 3/125 4/576.1
6,012,182 A * 1/2000 Allen ..... A61G 5/14 5/503.1
6,131,213 A * 10/2000 Sarff ..... A47K 3/003 211/105.1

(Continued)

*Primary Examiner* — Jeffrey O'Brien
(74) *Attorney, Agent, or Firm* — Botkin & Hall, LLP

(57) ABSTRACT

A standing assistive device is provided having a wall bracket and an arm portion with handle. The wall bracket may be affixed to a wall either in front of or behind either side of a toilet. The arm is mounted to the wall bracket with two pivots; one pivot that allows the unit to swing up and down which facilitates storage of the unit against the wall vertically when not in use; and a second pivot that allows the unit to swing left to right which facilitates storage of the unit against the wall horizontally when not in use. Additionally, the second pivot makes it possible for the handle on the arm portion to be positioned directly in front of the user when the user pulls himself or herself up. An optional wall-mounted ladder bracket allows the user to adjust the vertical mounting position of the device.

16 Claims, 10 Drawing Sheets

(56) References Cited

U.S. PATENT DOCUMENTS 6,230,339 B1 * 5/2001 McCrink ..... A47K 3/003 4/559
6,308,843 B1 * 10/2001 De Boer ..... D06F 53/04 211/104
6,843,468 B2 * 1/2005 Marshall ..... A47K 3/003 248/205.1
6,974,134 B1 * 12/2005 Macri ..... B60N 3/023 16/412
7,171,705 B1 * 2/2007 Hicks ..... A47K 3/003 292/262
7,249,395 B2 * 7/2007 Brammer, Jr. ..... E05B 1/0015 16/412
D582,021 S * 12/2008 Stimpson ..... D23/304
D584,129 S * 1/2009 Miller ..... D8/315
D596,278 S * 7/2009 Stimpson ..... D23/304
D623,928 S * 9/2010 Weber ..... D8/376
7,823,229 B2 * 11/2010 O'Brien ..... A47K 17/024 4/573.1
7,849,564 B2 * 12/2010 Miller ..... A47K 17/022 16/436
8,661,740 B2 * 3/2014 Lin ..... E06B 11/085 248/292.13
9,113,757 B2 * 8/2015 Desai ..... A47K 17/022
9,205,018 B2 * 12/2015 Hinkle ..... A61H 3/00
9,433,547 B2 * 9/2016 Hart ..... A61G 5/14
D779,644 S * 2/2017 Waggoner ..... D23/304
9,795,260 B2 * 10/2017 Castellini ..... A47K 3/281
2008/0093518 A1 * 4/2008 Roth ..... A47K 3/38 248/207
2008/0216227 A1 * 9/2008 Felmeri ..... A47K 10/38 4/511
2008/0289296 A1 * 11/2008 Weber ..... A47K 3/003 52/835
2010/0251469 A1 * 10/2010 Kim ..... A47K 17/024 4/254
2012/0246813 A1 * 10/2012 Manning ..... A47K 17/026 4/254
2016/0143494 A1 * 5/2016 Thomas ..... A47K 17/024 4/254
2017/0258652 A1 * 9/2017 Latham ..... A61G 5/14

* cited by examiner

STANDING ASSISTIVE DEVICE

BACKGROUND OF THE INVENTION

This present disclosure relates to a standing assistive device individuals can use to stand up from a seated position on a toilet. For many, limited finances or modesty dictates that a caregiver is out of the question for help up and off of a toilet. As a result, many individuals with limited mobility rely on devices such as walkers, canes and grab bars to assist them in standing up after using a toilet. Unfortunately, these devices are potentially unstable for such use, setting the stage for a dangerous fall. An improved standing assistive device with mounting flexibility is needed.

SUMMARY OF THE INVENTION

The present disclosure describes an adjustable wall mounted handle that can store flat against the wall when not in use, and pivot to a predetermined position, allowing the user to grab it and pull themselves up. Once up, users can then move the handle back to the stored position. Several unique features, such as an adjustable arm, allow the device to be configured for users of different arm lengths, sizes, or needs. The device can be mounted to the wall behind either side of a toilet, allowing the user and installer flexibility. The device pivots left and right to allow the handle to move to be more centrally located in front of users, while being able to swing away once the user is standing. With an alternative mounting bracket, the height may also be adjustable to allow users of different heights to position the device as it is attached to a wall.

BRIEF DESCRIPTION OF THE DRAWINGS

A preferred embodiment of this invention has been chosen wherein.

DESCRIPTION OF THE PREFERRED EMBODIMENT

Figure 1:
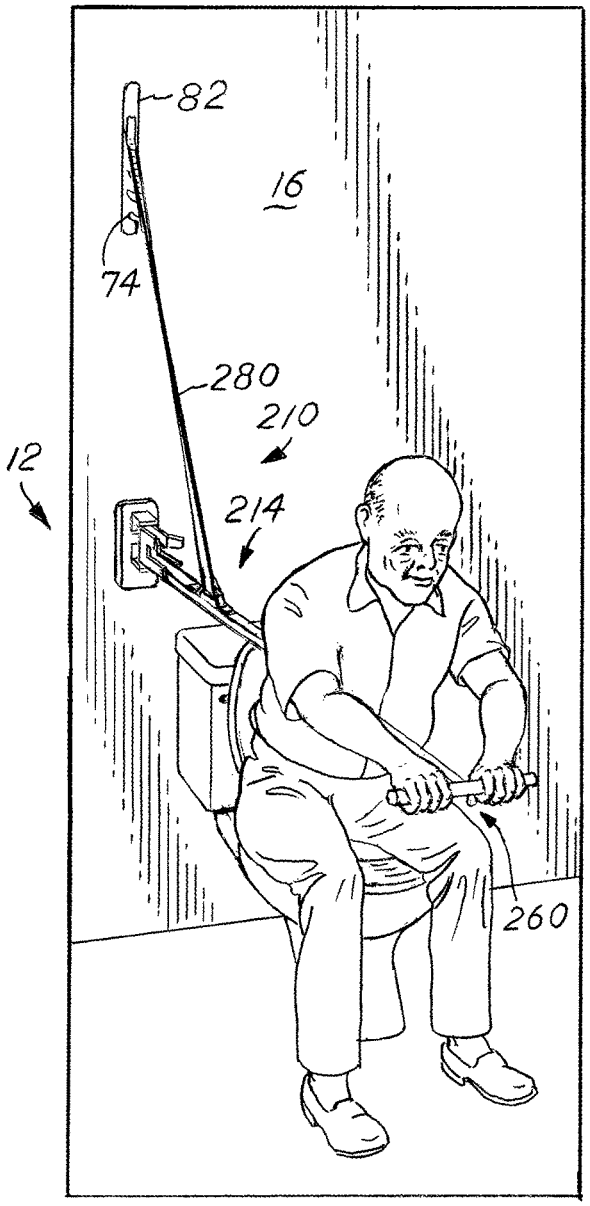
FIG. 1 is a front isometric view of the device in use.
Figure 2:
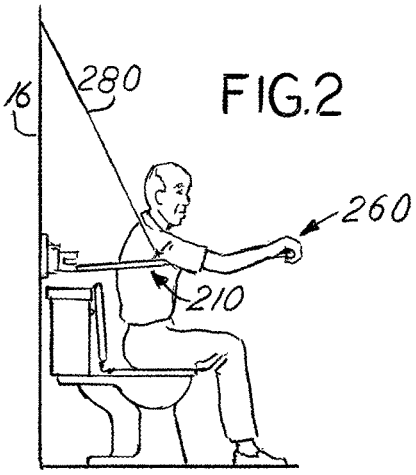
FIG. 2 is a side view of the device with the user beginning to lift themselves.
Figure 3:
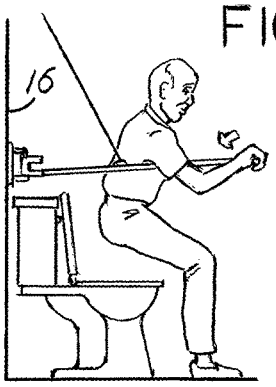
FIG. 3 is a side view of the device with the user in the process of lifting themselves.
Figure 4:
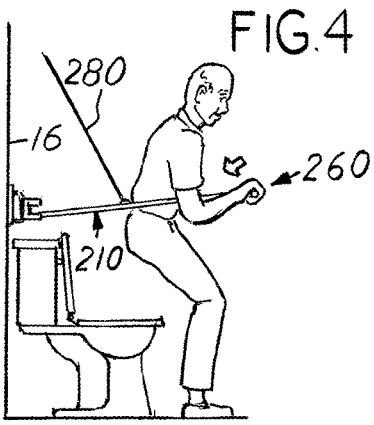
FIG. 4 is a side view of the device and the user mostly standing up.

The device 210 as shown in FIGS. 1-6 has a wall mount 212 and an arm 214. The device 210 is designed to be affixed to a wall 16 as shown in FIG. 1 and moved from a use position and a stored position. In the use position as shown in FIGS. 1-5, the user can use the device 210 for assistance in standing from a seated position. In the stored position, the device pivots up and out of the way as shown by hidden lines in FIG. 9.

Figure 17:
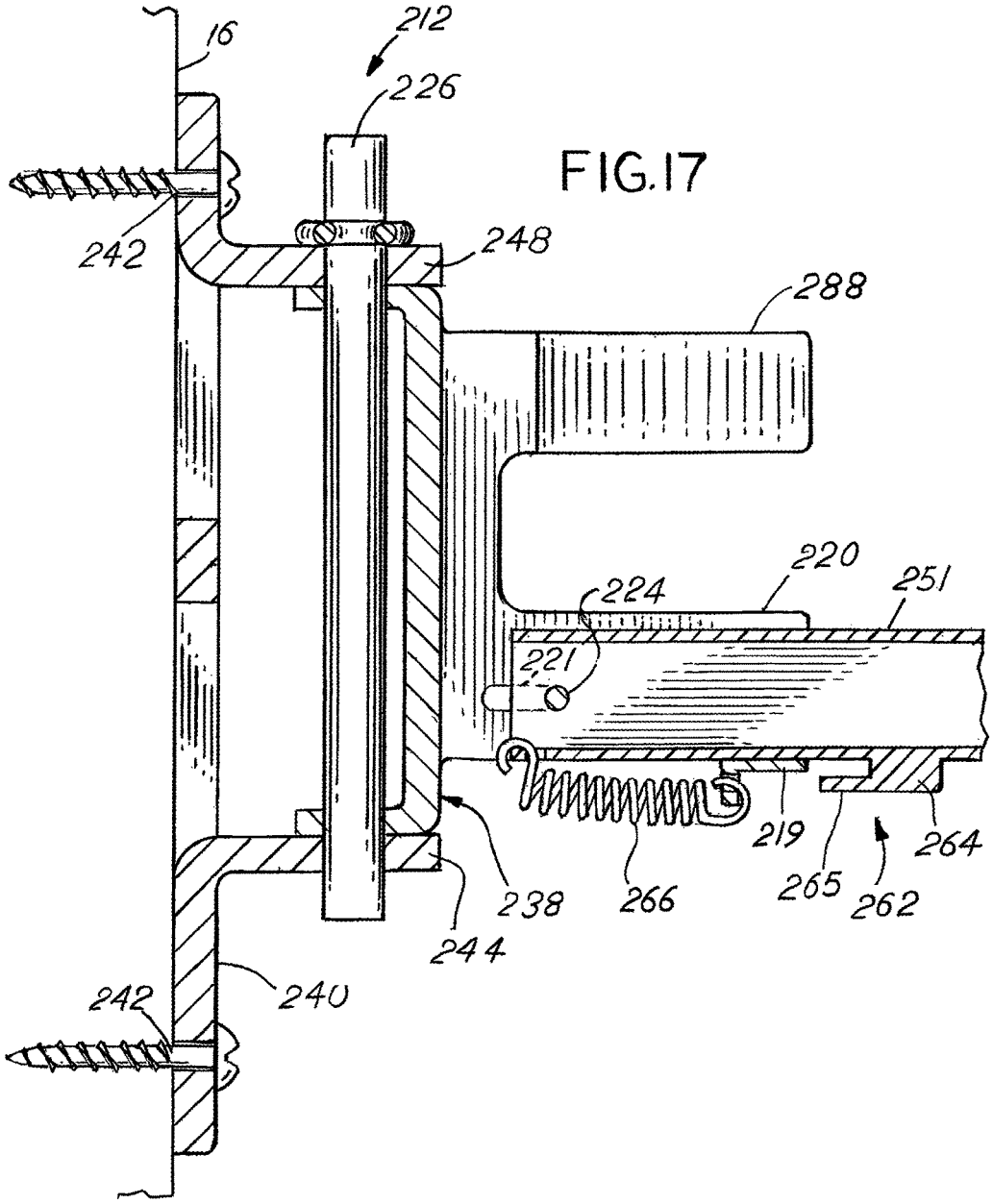
FIG. 17 is a side section view 17-17 of the device in FIG. 16 in the resting position.

The wall mount 212 as shown in FIGS. 13-19 has a pivoting bracket 238 that is commonly stamped or formed from a single piece of metal. The arm 214 attaches to the wall mount 212, and pivots where the pin 224 passes through the hole or slot 221 as shown in FIG. 17. As shown, the arm 214 is an elongate tube with a first portion 250 that commonly is hollow. A second portion 252 mates with the first portion 250 and can slide, making the arm 214 longer or shorter, as the user may need. The fully extended position is shown in the FIGS. The second portion 252 includes a series of holes 256 extend along the length toward the end. The holes are sized to allow a pin 54 to pass through to lock the first portion 251 to the second portion 252, shown in FIG. 20. The first and second portion 250, 252 are shown as a tube but other shapes or materials are possible. Other methods to fix the first portion 250 to the second portion 252 can include a push-to-release button, bolt, cotter pin, and other devices that can fix the two portions. It is contemplated that the second portion 252 fits inside the first portion 250.

At one end of the second portion 252 is a removable handle 260. The handle 260 can be removed from the arm 214 and reinstalled in other orientations. By allowing the handle 260 to be placed in different orientations, the device 10 can be installed on one side or the other of the toilet or be mounted to be more tailored to the individual user's physical limitations. For example, FIG. 1 shows the device 10 installed on one side of a toilet. The device 10 as shown in other FIGS. has the handle 260 installed in other orientations, allowing the installation of the device to be flexible.

Figure 9:
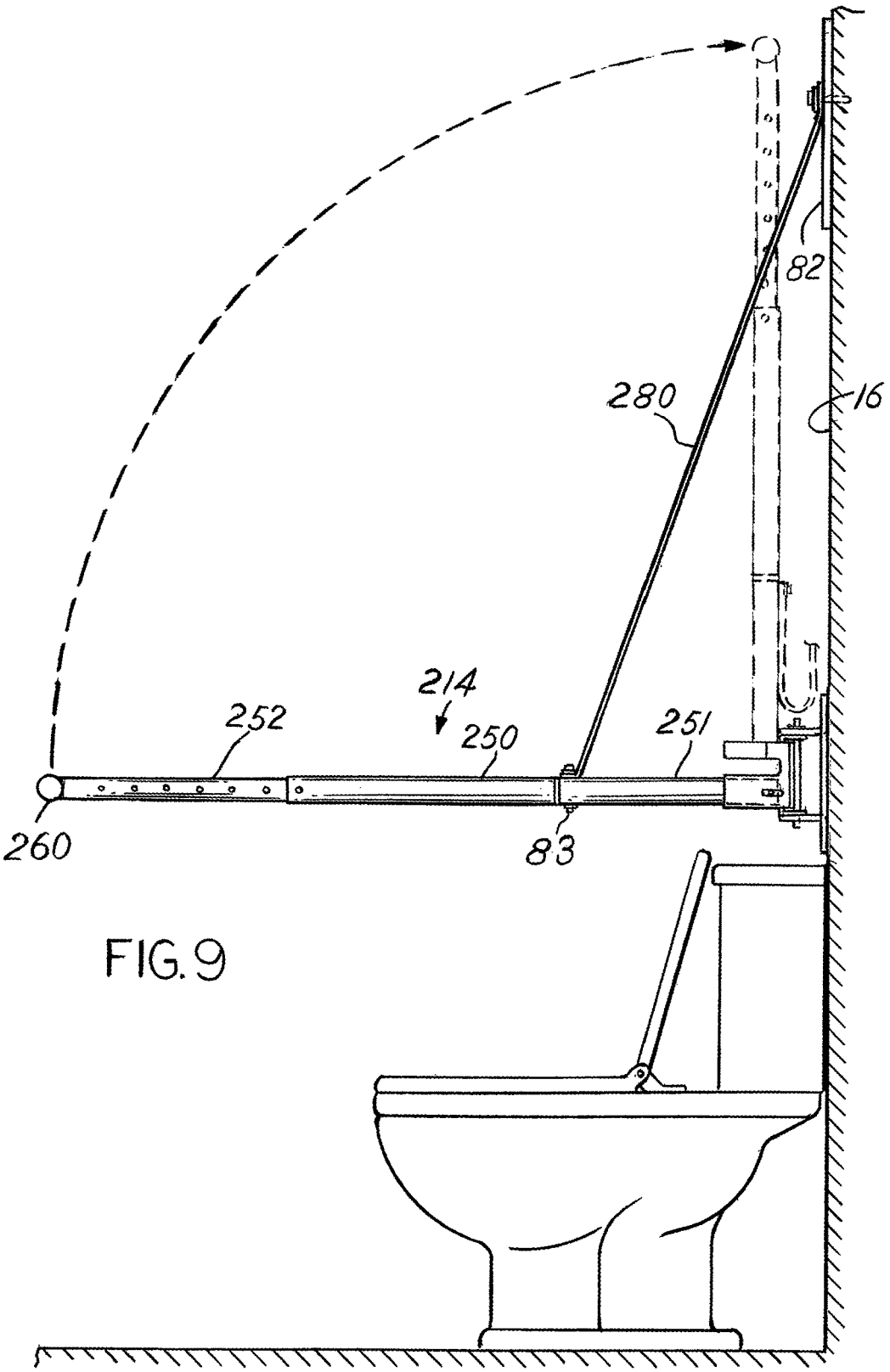
FIG. 9 is a side view of the device as affixed to a bathroom wall.
Figures 10, 11, 12:
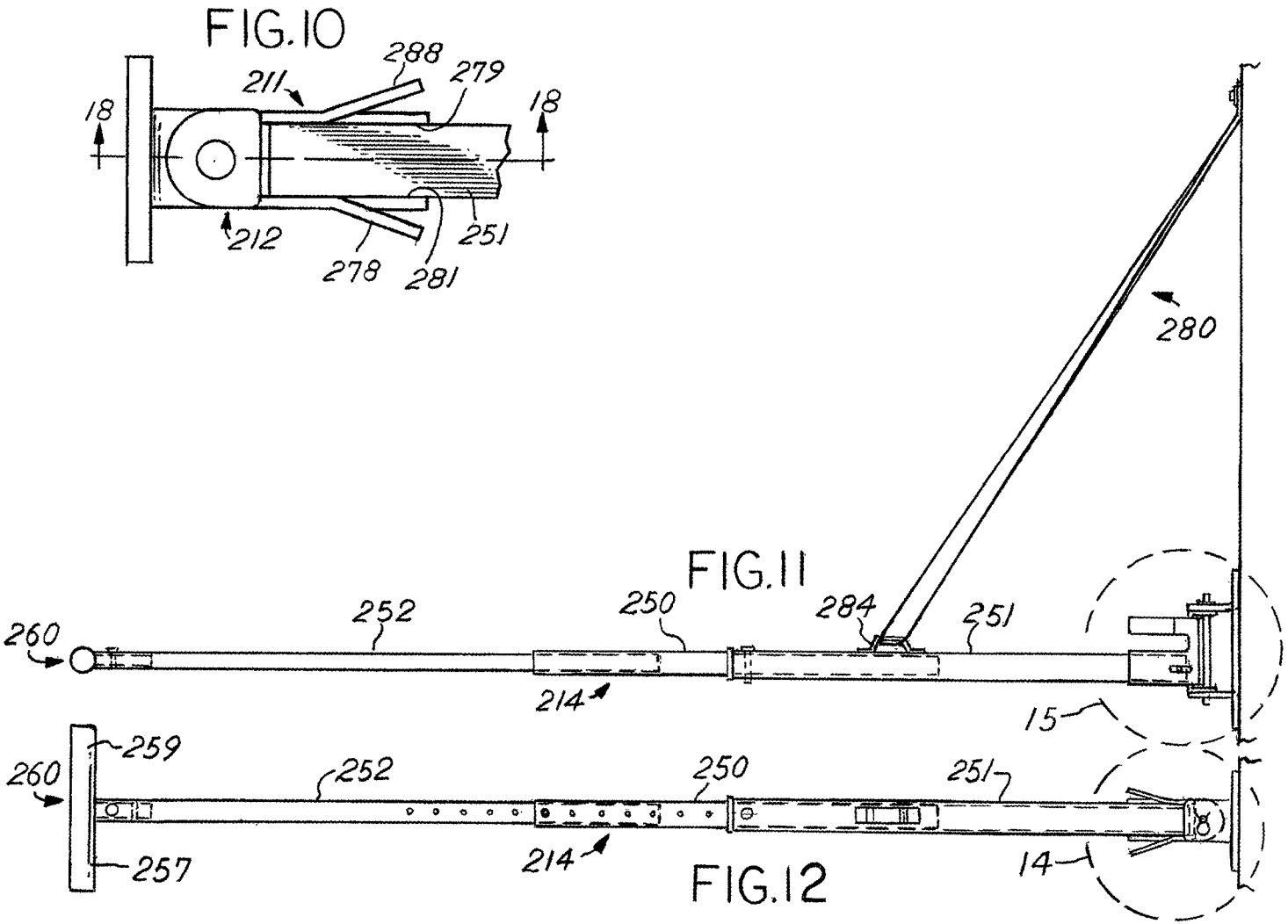
FIG. 10 is a partial top view of the device.
FIG. 11 is a side view of the device as shown in FIG. 9.
FIG. 12 is a top view of the device as shown in FIG. 9.
Figure 13:
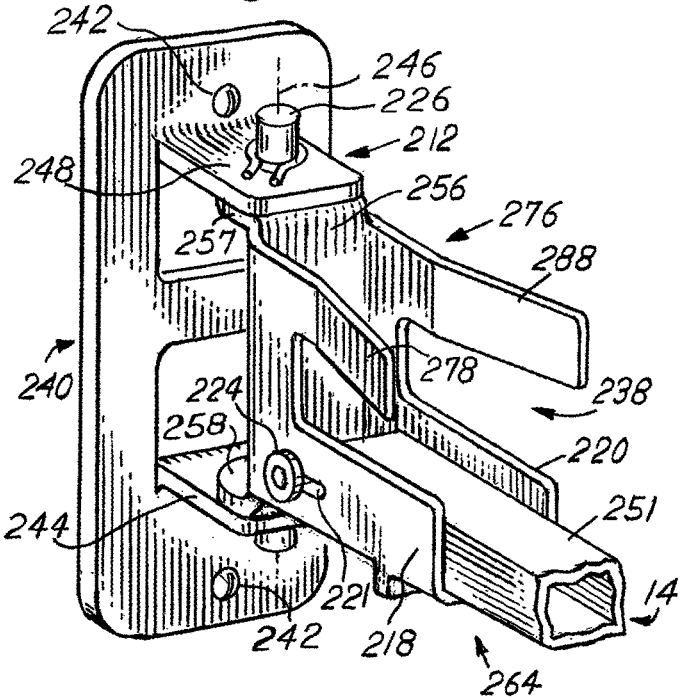
FIG. 13 is a partial isometric view of the device as shown in FIG. 5.
Figure 14:
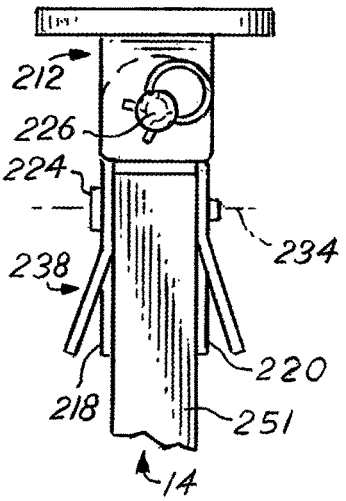
FIG. 14 is a side view of the device as shown in FIG. 5.
Figure 15:
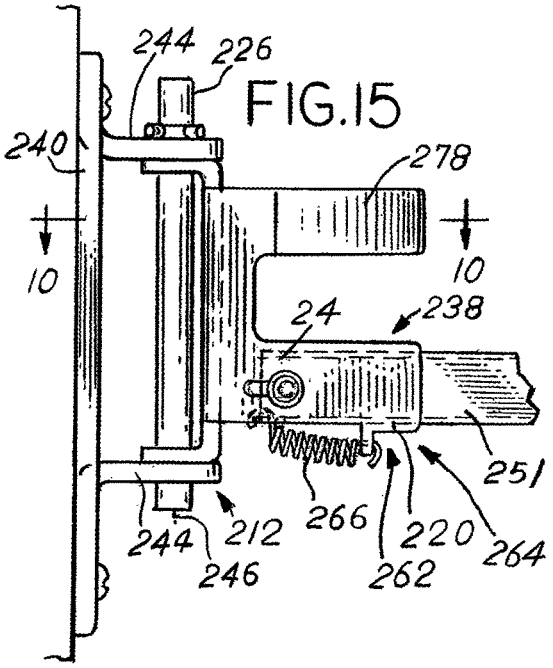
FIG. 15 is a top view of the device as shown in FIG. 5.
Figure 16:
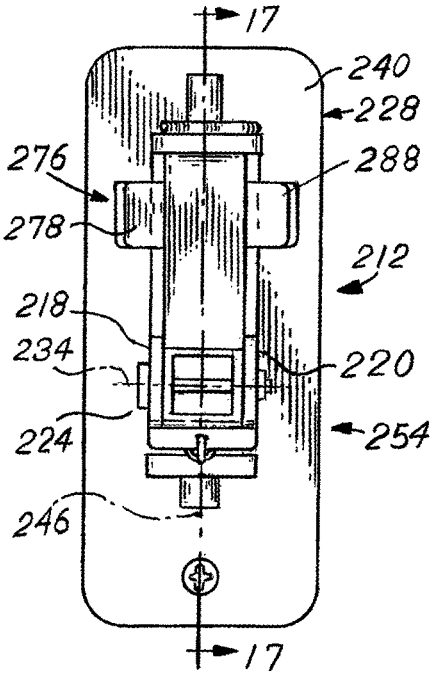
FIG. 16 is an end view of the device as shown in FIG. 5.

As shown in FIG. 9, the device 10 pivots between a stored position and a use position. In the use position, the arm 14 extends outwardly from the wall 16. The stored position puts the handle 260 near or against the wall.

A strap 280 is affixed to the wall 16 above the wall mount 212. The other end is affixed to the arm 14 at an attachment point 284 to limit the travel of the arm 214 in the use position. The strap 280 is commonly hook-and-loop to allow the length of the strap to be adjusted. As shown in FIG. 1, an adjustable bracket 82 at one end is affixed to the wall 16 using a fastener 46. The bracket 82 contains a series of angled slots 74, FIG. 1 that allow it to hang on fastener 46. The angled slots 74 allow the bracket 82 to be positioned vertically, allowing for different lengths of the arm 14, as the user may need.

The device 210 is stored most of the time, where the arm 214 is mostly vertical and the handle 260 is close to the wall 16 and located above the wall mount 212. When the user desires to move from the sitting position to the standing position, the arm 214 is moved from the stored position to the use position. This moves the arm 214 to a mostly horizontal position, placing the handle 260 far away from the wall 16. The user then grabs the handle 260 to support themselves as they move between the standing or sitting position. After the device 210 is no longer needed, it can be moved back to the stored position.

The device 210 is shown in FIGS. 1-19. The device 210 has an arm 214 that is connected to a wall mount 212. The wall mount 212 has a pivoting bracket 238 and a wall portion 240. The pivoting bracket 238 is connected to the wall portion 240 using a pivoting pin 226. The pivoting pin 226 allows the pivoting bracket 238 to rotate with respect to the base 240 about a first axis 246. A sliding pin 224 allows the arm 214 to pivot and slide with respect to the pivoting bracket 238 about an arm axis 234.

Figures 20, 21:
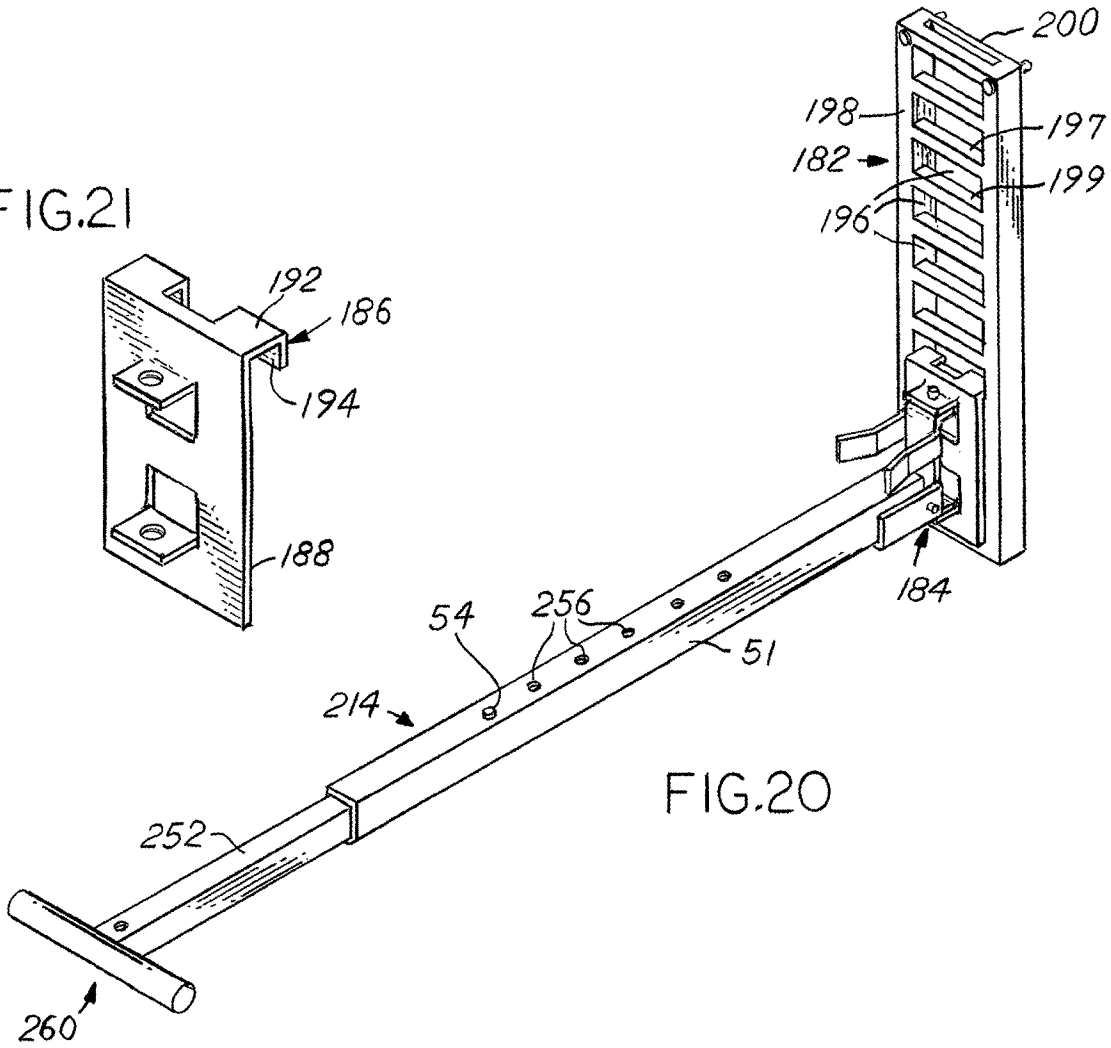
FIG. 20 is an isometric view of the device with a ladder adjustment bracket.
FIG. 21 is an isometric view of the bracket attachment portion for use with the ladder adjustment bracket.

The arm 214 is an elongate member, commonly hollow and made out of portions 250, 251, and 252. The portions 250, 251, 252, allow the length of the arm 214 to be adjusted for different installations. A t the end of the arm 214, attached to portion 252, is a handle 260. The handle 260 is typically inserted into the end of portion 252 and affixed through a pin. The handle 260 has different holes to allow it to be affixed to portion 252 in different angles. As shown in FIG. 20, the handle 260 is affixed in the horizontal orientation, but the different holes allow it to be affixed in the vertical position as well. A strap 280 is affixed to the arm 214 at an attachment point 282 and has an oppositely located wall attachment 284 that is affixed to the wall 16. The strap 280 provides support when downward force is applied to the arm 214. The strap 280 is shown in FIGS. 20 and 21.

The wall portion 240 has an upper bracket attachment portion 248 and lower bracket attachment portion 244 that are bent outwardly and away from the mounting surface. The wall portion 240 has mounting holes 242 to allow the wall portion 240 to be affixed to a wall 16, shown in FIG. 17. The wall portion 240 is shown as stamped from a single sheet of metal, but other materials and shapes are contemplated.

The pivoting bracket 238 shares some features with pivoting bracket 11 (shown in FIG. 9) but contains additional features. The upper part of the pivoting bracket 218 has a storage catch portion 276 and the lower part has the arm pivot portion 254. The storage catch portion has retaining walls 278, 288 that are located above the first tab 218 and second tab 220. The retaining walls 278, 288 are bent outwardly near their ends to generate an area that guides and centers the arm 214 as it is being moved to the storage position, shown in FIG. 19. The retaining walls 278, 288 are spaced apart such that when the first portion 251 of the arm 214 is moved between them, the arm is retained. The retaining walls 278, 288 may further include a snap or hook that must be released before the arm 214 can be moved into the use position. The arm pivot portion 254 includes a bottom wall 219 that connects a first tab 218 to the second tab 220. The tabs 218, 220 each have a slot 221 that carry the sliding pin 224 and allow it to slide. The arm pivot portion 254 is attached to the storage catch portion 276 with a back wall 256. The back wall has an upper tab 257 and a lower tab 258. The pivoting pin 226 passes through the upper and lower tabs 257, 258 and the upper and lower bracket attachment portions 248, 244 to allow the pivoting bracket 238 to pivot about the first axis 246.

Figure 5:
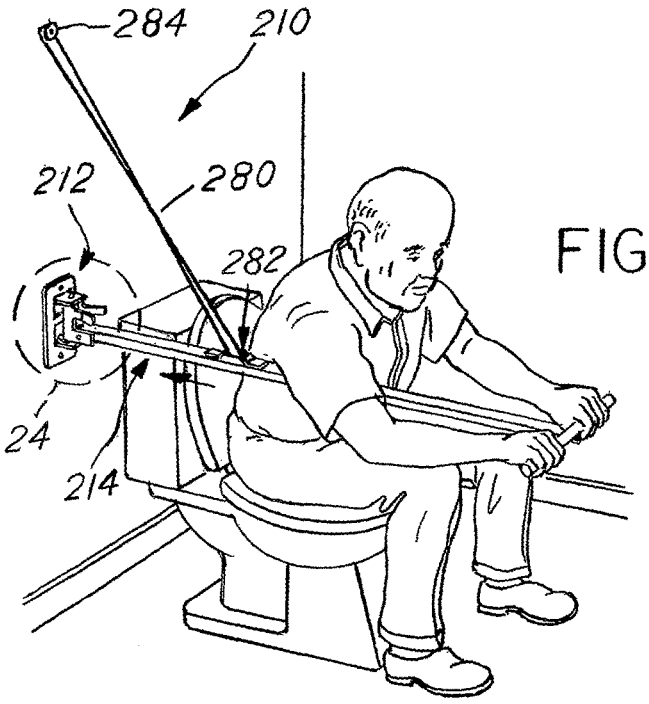
FIG. 5 is an isometric side view of the device mounted behind the user.
Figure 6:
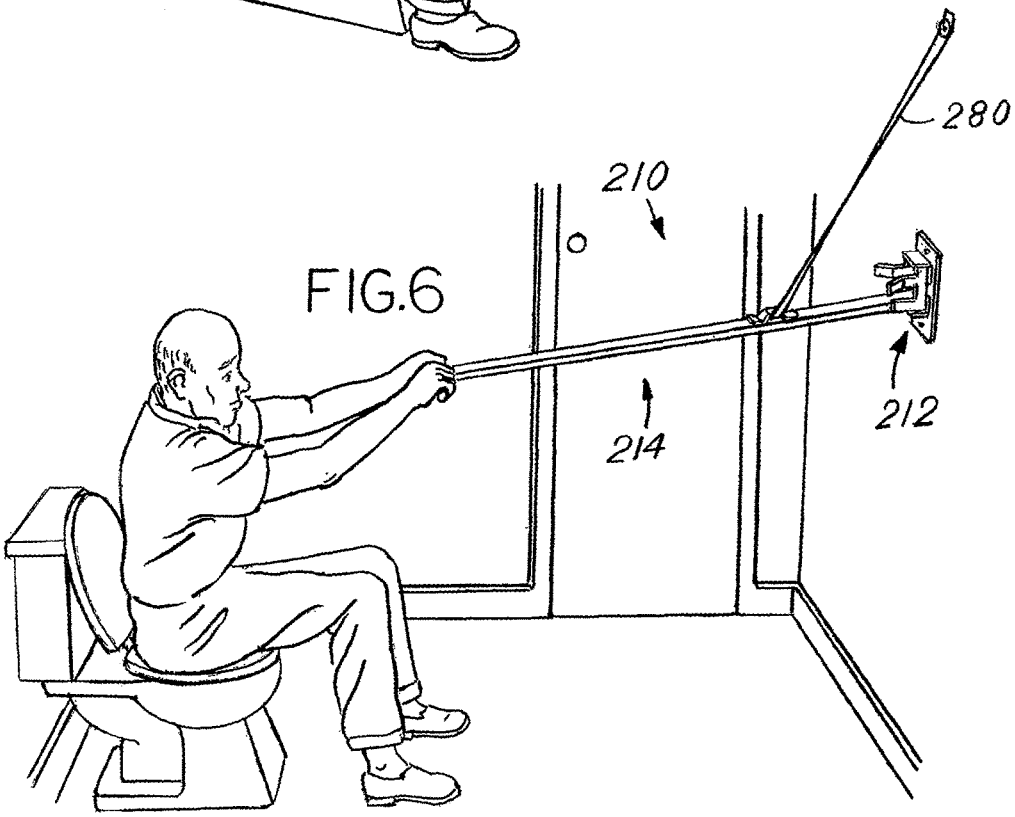
FIG. 6 is an isometric side view of the device mounted in front of the user.
Figure 7:
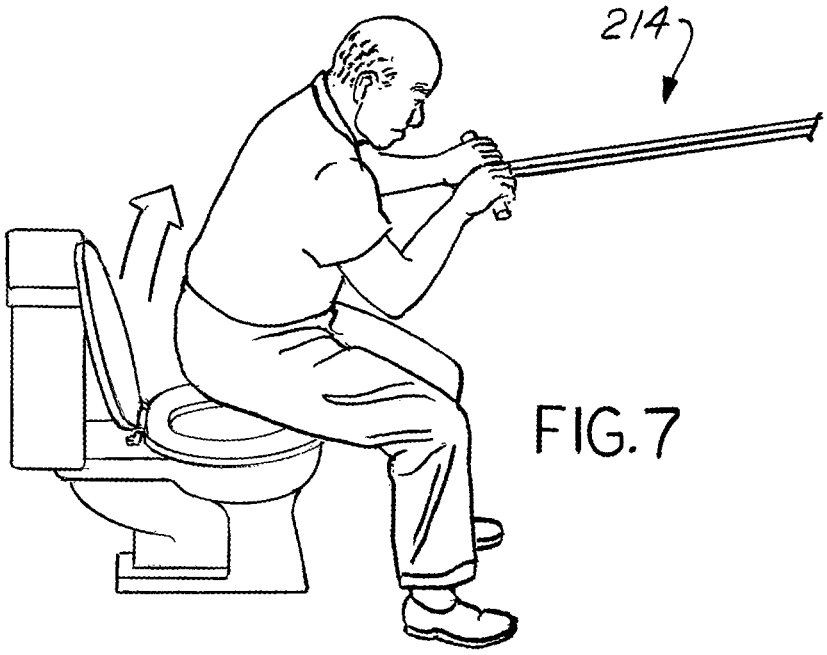
FIG. 7 is a view of the user pulling themselves up from a sitting position.
Figure 8:
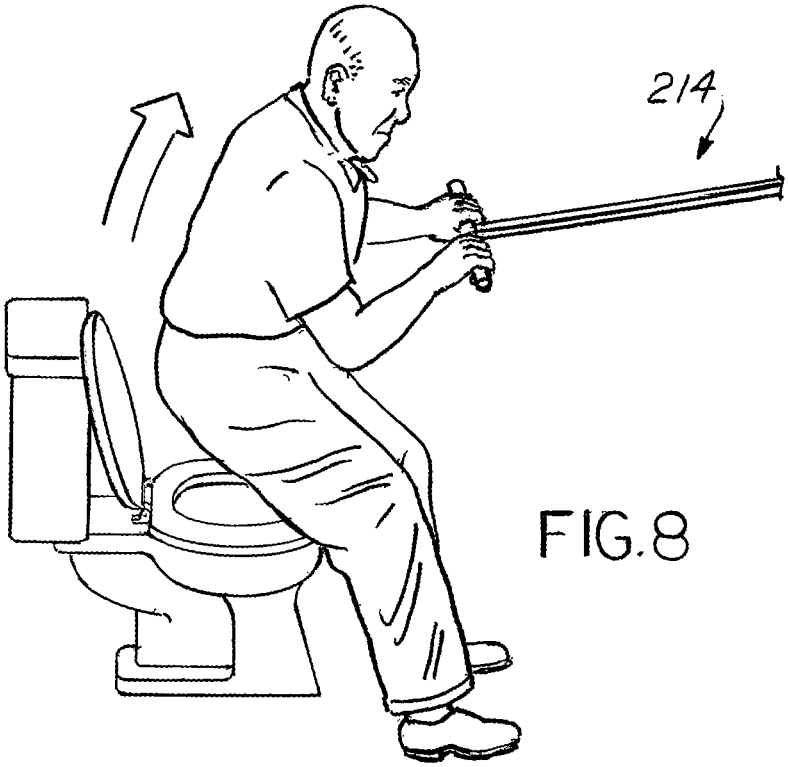
FIG. 8 is a view of the user using the device to move to the standing position.
Figure 18:
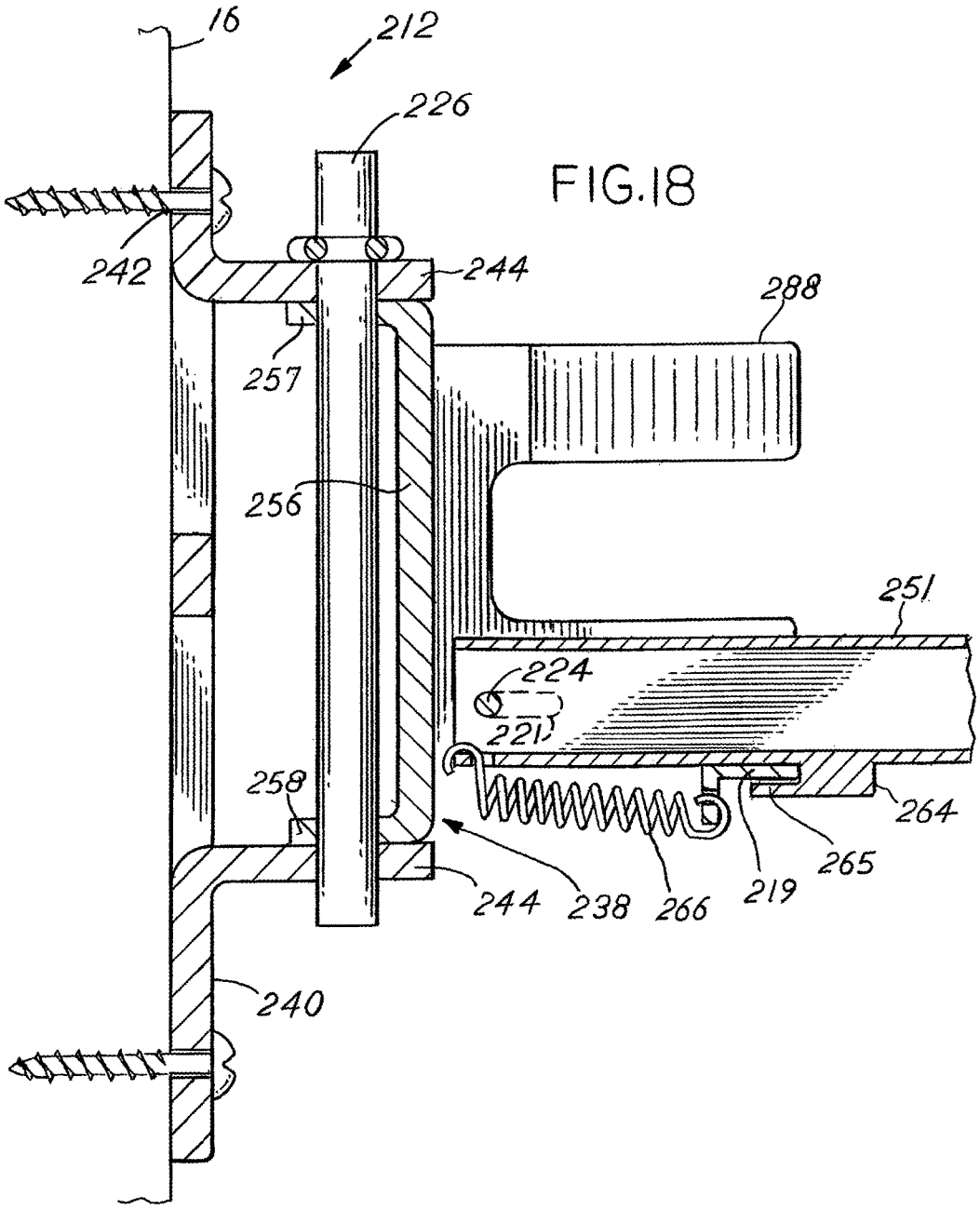
FIG. 18 is a side section view 17-17 of the device in FIG. 16 in the locked position.
Figure 19:
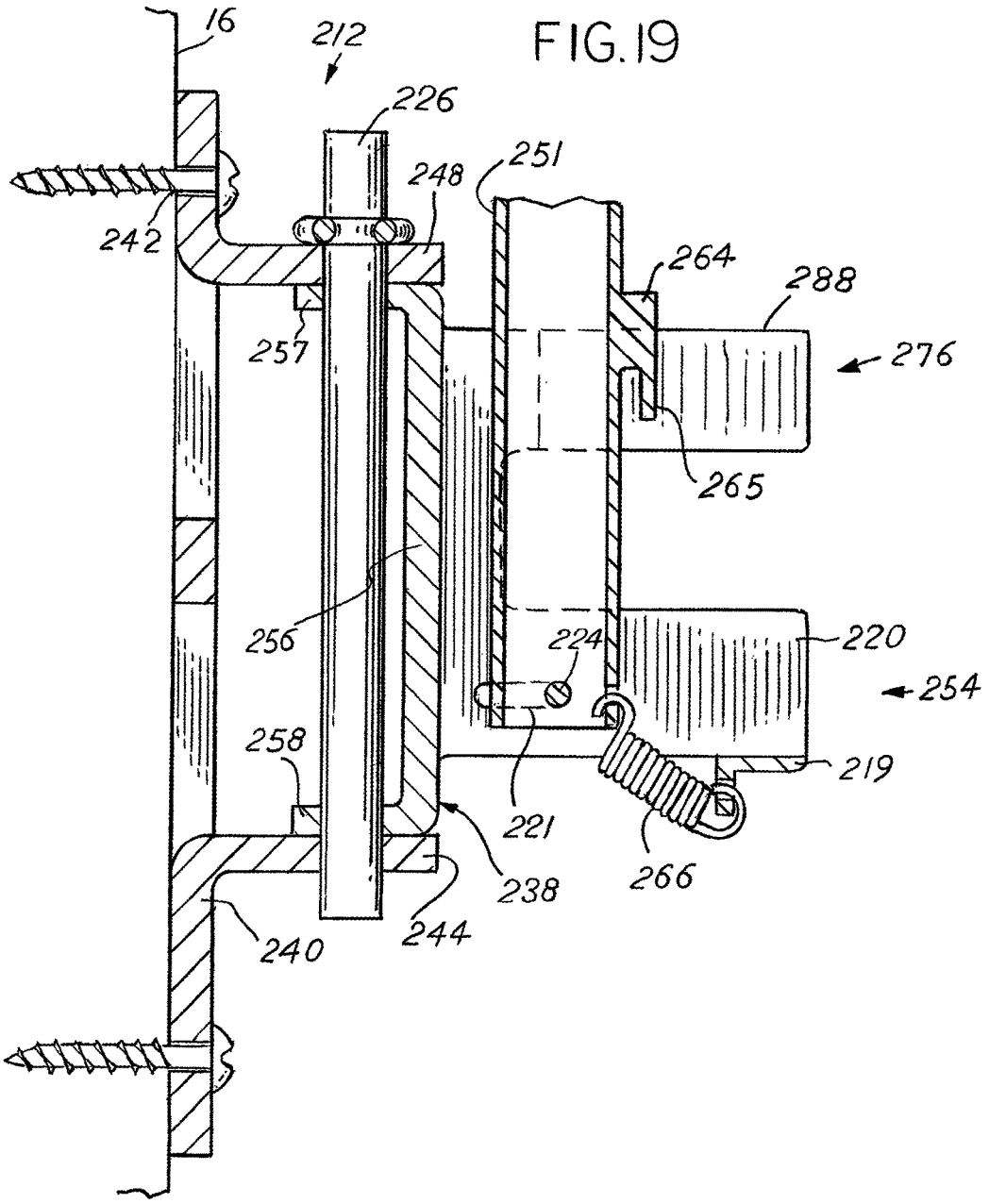
FIG. 19 is a side section view 17-17 of the device in FIG. 16 in the stored position.

A safety catch 262 is shown in FIGS. 17-18. The safety catch 262 has a hook portion 264 affixed to the arm 214 and a spring 266 that biases the arm 214 away from the back wall 256. The hook portion 264 has an overhanging wall portion 265 that is spaced from the arm 214 and is shown as parallel to it. The overhanging wall portion 254 does not have to be parallel as long as the bottom wall or a portion of the pivoting bracket 238 can be located between the arm 214 and hook portion 264. The spring 266 hooks to the bottom wall 219 on one end and the portion 251 of the arm 14. This is shown in FIGS. 17-19. In the resting or unlocked position, shown in FIG. 17, the spring has pulled the arm 214 away from the pivoting bracket 238. The hook portion 264 is spaced away and disengaged with the bottom wall 219. The sliding pin 224 is biased against one end of the slots 221. When the user pulls the arm 214 towards the wall 16 (as shown in FIG. 5) the sliding pin 224 moves to the other end of the slots 221 and the hook portion 264 engages the bottom wall 219. This is shown in FIG. 18. When the hook portion 264 is engaged, the user cannot pivot the arm 214 to the stored position. The stored position is shown in FIG. 19. By locking the arm 214 to the pivoting bracket 238, an unsteady user is prevented from accidentally pivoting the arm upwards and losing balance.

When the user desires the arm 214 to be stored and out of the way, the user simply pivots the arm 214 upward. The arm 214 enters the storage catch portion 276 where it is between the retaining walls 278, 288. Friction between the arm 214 and the retaining walls 278, 288 maintain the arm in its stored position. It is contemplated that magnets or another catch mechanism is used to retain the arm in the stored position.

The device 180 shown in FIGS. 20 and 21 may optionally include a wall-mounted ladder 182 where a wall mount 184 further includes a catch portion 186. FIG. 21 shows the wall mount without the pivoting bracket or arm. The catch portion 186 extends outwardly where the wall portion 188 meets the bracket attachment portion 190. The catch portion 186 is made up of an offset wall portion 192 and a hook portion 194. The ladder 182 has a series of apertures 196 that extend from an outer surface 198 toward a wall-facing surface 200. The apertures 196 have a transverse surface 199 where the offset wall portion 192 rests. The hook portion 194 hooks through the aperture and contacts a rear surface 197 that is opposite the outer surface 198. The ladder 182 is affixed to the wall 16 with the wall-facing surface 200 directly contacting the wall 16.

It is understood that while certain aspects of the disclosed subject matter have been shown and described, the disclosed subject matter is not limited thereto and encompasses various other embodiments and aspects. No specific limitation with respect to the specific embodiments disclosed herein is intended or should be inferred. Modifications may be made to the disclosed subject matter as set forth in the following claims.

What is claimed is:

1. A standing assistive system adapted to be affixed to a substantially vertical surface, said system comprising:

a wall mount having a wall portion and a pivoting bracket pivotably connected to said wall portion, said wall mount adapted to be affixed to said vertical surface;

said wall portion of said wall mount having an upper and lower bracket attachment portion extending outwardly from said wall portion, said upper bracket attachment portion having inner surfaces being parallel with respect to an inner surface of said lower bracket attachment portion;

said pivoting bracket having back wall extending between an upper tab and a lower tab, said back wall of said pivoting bracket having a first and second retaining wall extending therefrom, said first and second retaining walls being spaced relatively near each other adjacent to said back wall and said first and said second retaining walls being spaced farther apart at a location farther from said back wall, said first retaining wall, and said second retaining wall defining a storage catch portion adjacent to said upper tab, said pivoting bracket having an arm pivot portion affixed to said back wall adjacent said lower tab, said arm pivot portion having a first tab, a second tab spaced from and substantially parallel to said first tab, and a bottom wall connecting said first tab and said second tab, said first and second tabs each having a slot and a sliding pin riding in said slots, said pivoting bracket joined to said wall portion by a pivoting pin extending through said upper and said lower tabs of said pivoting bracket and said upper and said lower bracket attachment portions to facilitate rotation of said pivoting bracket with respect to said wall portion about a first axis, said first axis fixed with respect to said wall portion;

an elongate arm having a pivot aperture near a proximal end, said pivot aperture extending through said elongate arm, said elongate arm having a removable handle located at a terminal end, said sliding pin extending through said pivot aperture and said slots in said first and said second tabs, said sliding pin retained along a length of said slots to facilitate movement of said elongate arm between an unlocked position and a locked position, said unlocked position defined by said sliding pin located relatively far from said back wall, and said locked position defined by said sliding pin located relatively nearer said back wall, said elongate arm having a hook portion affixed thereto and having an overhanging portion parallel to and spaced from said arm, said locked position defined by a portion of said bottom wall being located between said elongate arm and said overhanging portion;

a spring affixed to said elongate arm at a first end and said bottom wall at a second end, said spring biasing said elongate arm towards said unlocked position;

a strap affixed to said elongate arm and having an end adapted to be affixed to said substantially vertical surface; and said elongate arm pivotable about an arm axis between a stored position and said unlocked position, said stored position defined by a portion of said elongate arm located between said first and said second retaining walls.

2. The device of claim 1, wherein said elongate arm is formed from first and second tubular portions, said first and said second tubular portions telescopically slidable with respect to each other, said first and said second tubular portions having transverse holes adapted to receive a first fastener, said first and second tubular portions fixed with respect to each other when said first fastener is located in said transverse holes.

3. The device of claim 2, wherein said elongate arm has holes extending therethrough at a distal end, said holes adapted to receive a second fastener to affix said removable handle.

4. The device of claim 1, wherein said wall portion having a plurality of apertures extending therethrough and adapted to affix said wall mount to said vertical surface.

5. The device of claim 1, further comprising a ladder adapted to be affixed to said wall, said wall portion having an offset wall portion and a hook portion, said wall portion adapted to be affixed to said ladder.

6. A standing assistive system adapted to be affixed to a substantially vertical surface, said system comprising:

a wall mount having a wall portion and a pivoting bracket pivotably connected to said wall portion, said wall mount adapted to be affixed to said vertical surface;

said wall portion of said wall mount having an upper and lower bracket attachment portion extending outwardly from said wall portion;

said pivoting bracket extending between an upper tab and a lower tab, said pivoting bracket having a first and second retaining wall extending therefrom, said first and second retaining walls being spaced relatively near each other and said first and said second retaining walls being spaced farther apart at a location farther from said upper and lower tabs, said first retaining wall and said second retaining wall defining a storage catch portion adjacent to said upper tab, said pivoting bracket having an arm pivot portion adjacent said lower tab, said arm pivot portion having a first tab, a second tab spaced from and substantially parallel to said first tab, and a bottom wall connecting said first tab and said second tab, said first and said second tabs each having apertures and a first pin riding in said apertures, said pivoting bracket joined to said wall portion by a pivoting pin extending through said upper and said lower tabs of said pivoting bracket and said upper and lower bracket attachment portions to facilitate rotation of said pivoting bracket with respect to said wall portion about a first axis;

an elongate arm having a pivot aperture near a proximal end, said pivot aperture extending through said elongate arm, said elongate arm having a removable handle located at a terminal end, said first pin extending through said pivot aperture and said apertures in said first and said second tabs, said first pin retained in said apertures to facilitate movement of said elongate arm between an unlocked position and a locked position, said elongate arm having a hook portion affixed thereto and having an overhanging portion parallel to and spaced from said arm, said locked position defined by a portion of said bottom wall being located between said elongate arm and said overhanging portion;

a spring affixed to said elongate arm at a first end and said bottom wall at a second end, said spring biasing said elongate arm towards said unlocked position; and said elongate arm pivotable about an arm axis between a stored position and said unlocked position, said stored position defined by a portion of said elongate arm located between said first and said second retaining walls.

7. The device of claim 6, wherein said first and second retaining walls are bent outwardly near distal ends.

8. The device of claim 6, said upper bracket attachment portion having inner surfaces being parallel with respect to an inner surface of said lower bracket attachment portion.

9. The device of claim 6, wherein said pivot aperture in said elongate arm is a slot, said first pin extending through said slot to facilitate said movement between said locked position and said unlocked position.

10. The device of claim 6, wherein said apertures in said first and said second tabs are slots, said first pin extending through said slots to facilitate said movement between said locked position and said unlocked position.

11. The device of claim 10, wherein said unlocked position is defined by said first pin located relatively far from said wall portion, said locked position defined by said first pin located relatively nearer said wall portion.

12. The device of claim 6, further comprising a ladder adapted to be affixed to said wall, said wall portion having an offset wall portion and a hook portion, said wall portion adapted to be affixed to said ladder.

13. A standing assistive system adapted to be affixed to a substantially vertical surface, said system comprising:

a wall mount having a wall portion and a pivoting bracket pivotably connected to said wall portion, said wall mount adapted to be affixed to said vertical surface;

said wall portion of said wall mount having an upper and lower bracket attachment portion extending outwardly from said wall portion;

said pivoting bracket extending between an upper tab and a lower tab, said pivoting bracket having a first and second retaining wall extending therefrom, said first and second retaining walls being spaced relatively near each other, said first retaining wall and said second retaining wall defining a storage catch portion adjacent to said upper tab, said pivoting bracket having an arm pivot portion adjacent said lower tab, said arm pivot portion having a first tab and a second tab spaced from and substantially parallel to said first tab, and a bottom wall connecting said first tab and said second tab, said first and second tabs each having apertures and a first pin riding in said apertures, said pivoting bracket joined to said wall portion by a pivoting pin extending through said upper and lower tabs of said pivoting bracket and said upper and lower bracket attachment portions to facilitate rotation of said pivoting bracket with respect to said wall portion about a first axis;

an elongate arm having a pivot aperture near a proximal end, said pivot aperture extending through said elongate arm, said elongate arm having a removable handle located at a terminal end, said first pin extending through said pivot aperture and said apertures in said first and said second tabs, said first pin retained in said apertures;

wherein said apertures in said first and said second tabs each being a slot, said first pin extending through said slots and slidable along said length of said slots to facilitate movement of said elongate arm between an unlocked position and a locked position, said unlocked position defined by said first pin located relatively far from said back wall, and said locked position defined by said first pin located relatively nearer said back wall, said elongate arm having a hook portion affixed thereto and having an overhanging portion parallel to and spaced from said arm, said locked position defined by a portion of said bottom wall being located between said elongate arm and said overhanging portion; and said elongate arm pivotable about an arm axis between a stored position and said unlocked position, said stored position defined by a portion of said elongate arm located between said first and said second retaining walls.

14. The system of claim 13, further comprising a spring affixed to said elongate arm at a first end and said bottom wall at a second end, said spring biasing said elongate arm towards said unlocked position.

15. The system of claim 13, said first and second retaining walls being spaced farther apart at a location farther from said upper and said lower tabs.

16. The device of claim 13, said upper bracket attachment portion having inner surfaces being parallel with respect to an inner surface of said lower bracket attachment portion.

* * * * *